US006969796B2

(12) United States Patent
Sasaki

(10) Patent No.: US 6,969,796 B2
(45) Date of Patent: Nov. 29, 2005

(54) AUTOMATIC MUSIC PERFORMING APPARATUS AND AUTOMATIC MUSIC PERFORMANCE PROCESSING PROGRAM

(75) Inventor: Hiroyuki Sasaki, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 306 days.

(21) Appl. No.: 10/435,740

(22) Filed: May 8, 2003

(65) Prior Publication Data

US 2003/0213357 A1 Nov. 20, 2003

(30) Foreign Application Priority Data

May 14, 2002 (JP) ..... 2002-138017

(51) Int. Cl.[7] ..... G10H 7/00; G04B 13/00
(52) U.S. Cl. ..... 84/609; 84/645
(58) Field of Search ..... 84/609, 634, 645

(56) References Cited

U.S. PATENT DOCUMENTS 5,394,784 A * 3/1995 Pierce et al. ..... 84/464 A
6,025,550 A * 2/2000 Kato ..... 84/464 A
6,449,661 B1 * 9/2002 Fujishima ..... 710/5
6,570,081 B1 * 5/2003 Suzuki et al. ..... 84/622

FOREIGN PATENT DOCUMENTS

JP 11-237879 8/1999
JP 2002-2588841 A 9/2002

* cited by examiner

*Primary Examiner*—Jeffrey W Donels
(74) *Attorney, Agent, or Firm*—Frishauf, Holtz, Goodman & Chick, PC

(57) ABSTRACT

An automatic music performing apparatus comprises a performance memory for storing music performance data of a relative time format including an event group including at least note-on events indicating the note generation start, note-off events indicating the end of the note generation, volume events indicating the volumes of the tone, and tone color events indicating the tone color with the respective events arranged in a music proceeding sequence, and an interval of time interposed between respective two events, wherein the apparatus sequentially reads out the stored music performance data, converts it into note data representing the note generation properties of each note, and stores the note data in a conversion data memory, so that automatic music performance is executed by reading out the stored note data and forming tones corresponding to the note generation properties represented by the read note data.

11 Claims, 14 Drawing Sheets

AUTOMATIC MUSIC PERFORMING APPARATUS AND AUTOMATIC MUSIC PERFORMANCE PROCESSING PROGRAM

CROSS-REFERENCE TO RELATED APPLICATIONS

This application is based upon and claims the benefit of priority from the prior Japanese Patent Application No. 2002-138017, filed May 14, 2002, the entire contents of which are incorporated herein by reference.

BACKGROUND OF THE INVENTION

1. Field of the Invention

The present invention relates to an automatic music performing apparatus and an automatic music performance processing program preferably used in electronic musical instruments.

2. Description of the Related Art

Automatic music performing apparatuses such as sequencers and the like include a sound source having a plurality of sound generation channels capable of simultaneously generating sounds and executing automatic music performance in such a manner that the sound source causes each sound generation channel to generate and mute a sound according to music performance data of an SMF format (MIDI data) that represents the pitch and the sound generation/mute timing of each sound to be performed and further represents the tone, the volume, and the like of a music sound to be generated as well as creates, when a sound is generated, a music sound signal having a designated pitch and volume based on the waveform data of a designated tone.

Incidentally, when electronic musical instruments having an automatic music performing function are commercialized as products, mounting a dedicated sound source thereon, which interprets and executes music performance data of the SMF format (MIDI data) as used in conventional automatic music performing apparatuses described above, inevitably results in an increase in a product cost. To achieve the automatic music performing function while realizing a low product cost, it is essential to provide an automatic music performing apparatus capable of automatically performing music according to music performance data of the SMF format without providing a dedicated sound source.

BRIEF SUMMARY OF THE INVENTION

An object of the present invention, which has been made in view of the above circumstances, is to provide an automatic music performing apparatus capable of executing automatic music performance according to music performance data of an SMF format, without a dedicated sound source.

That is, according to one aspect of the present invention, first, the automatic music performing apparatus comprises a music performance data storing means for storing music performance data of a relative time format including an event group, which includes at least note-on events for indicating the start of sound generation of music sounds, note-off events for indicating the end of sound generation of the music sounds, volume events for indicating the volumes of the music sounds, and tone color events for indicating the tone colors of the music sounds with the respective events arranged in a music proceeding sequence, and difference times each interposed between respective events and representing a time interval at which both the events are generated.

The music performance data of the relative time format stored in the music performance data storing means is converted into sound data representing the sound generation properties of each sound.

Next, automatic music performance is executed by forming music sounds corresponding to the sound generation properties represented by the converted sound data.

With the above arrangement, music performance is automatically executed by converting the music performance data of an SMF format, in which the sound generation timing and the events are alternately arranged in the music proceeding sequence, into sound data representing the sound generation properties of each sound and by forming music sounds corresponding to the sound generation properties represented sound data, whereby the music performance can be automatically executed without a dedicated sound source for interpreting and executing the music performance data of the SMF format.

DETAILED DESCRIPTION OF THE INVENTION

An automatic music performing apparatus according to the present invention can be applied to so-called DTM apparatuses using a personal computer, in addition to a known electronic musical instruments. An example of an automatic music performing apparatus according to an embodiment of the present invention will be described below with reference to the drawings.

(1) Overall Arrangement

Figure 1:
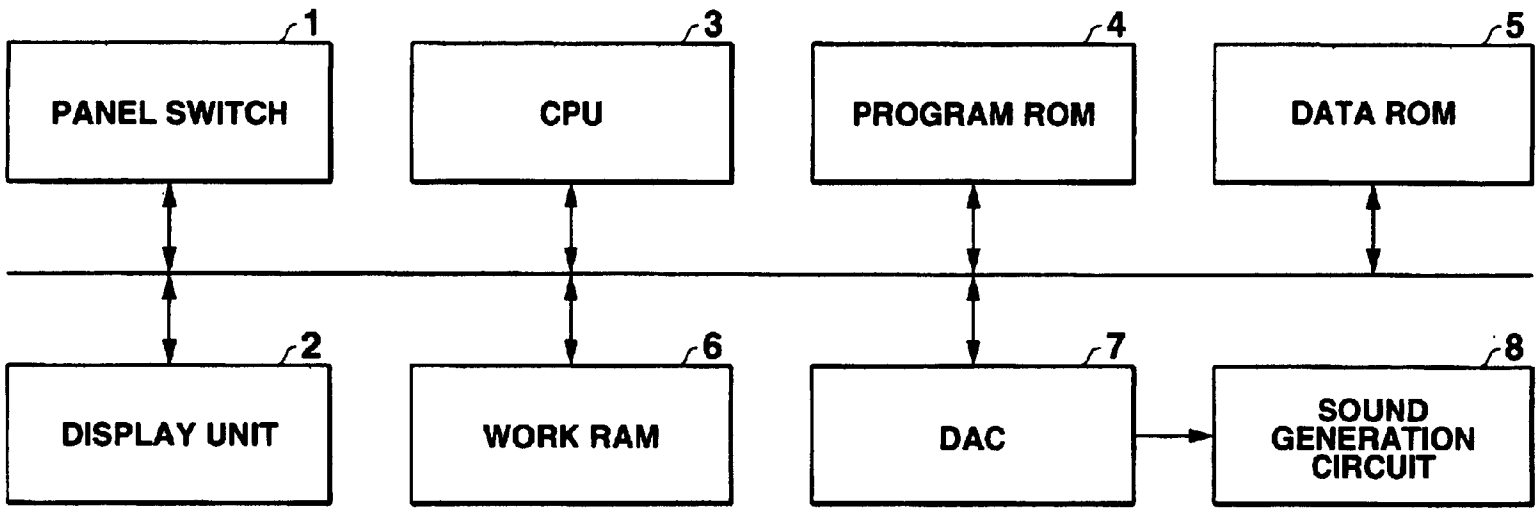
FIG. 1 is a block diagram showing an arrangement of an embodiment according to the present invention.

FIG. 1 is a block diagram showing an arrangement of the embodiment of the present invention. In the figure, reference numeral 1 denotes a panel switch that is composed of various switches disposed on a console panel and creates switch events corresponding to the manipulation of the various switches. Leading switches disposed in the panel switch include, for example, a power switch (not shown), a mode selection switch for selecting operation modes (conversion mode and creation mode that will be described later), and the like. Reference numeral 2 denotes a display unit that is composed of an LCD panel disposed on the console panel and a display driver for controlling the LCD panel according to a display control signal supplied from a CPU 3. The display unit 2 displays an operating state and a set state according to the manipulation of the panel switch 1.

The CPU 3 executes a control program stored in a program ROM 4 and controls the respective sections of the apparatus according to a selected operation mode. Specifically, when the conversion mode is selected by manipulating the mode selection switch, conversion processing for converting music performance data (MIDI data) of an SMF format into sound data (to be described later). In contrast, when the creation mode is selected, creation processing for creating music sound data based on the converted sound data and automatically performing music is executed. These processing operations will be described later in detail.

Reference numeral 5 denotes a data ROM for storing the waveform data and the waveform parameters of various tones. A memory arrangement of the data ROM 5 will be described later. Reference numeral 6 denotes a work RAM including a music performance data area PDE, a conversion processing work area CWE, and a creation processing work area GWE, and a memory arrangement of the work RAM 6 will be described later. Reference numeral 7 denotes a D/A converter (hereinafter, abbreviated as DAC) for converting the music sound data created by the CPU 3 into a music sound waveform of an analog format and outputting it. Reference numeral 8 denotes a sound generation circuit for amplifying the music sound waveform output from the DAC 7 and generating a music sound therefrom through a speaker.

(2) Arrangement of Data ROM 5

Figure 2:
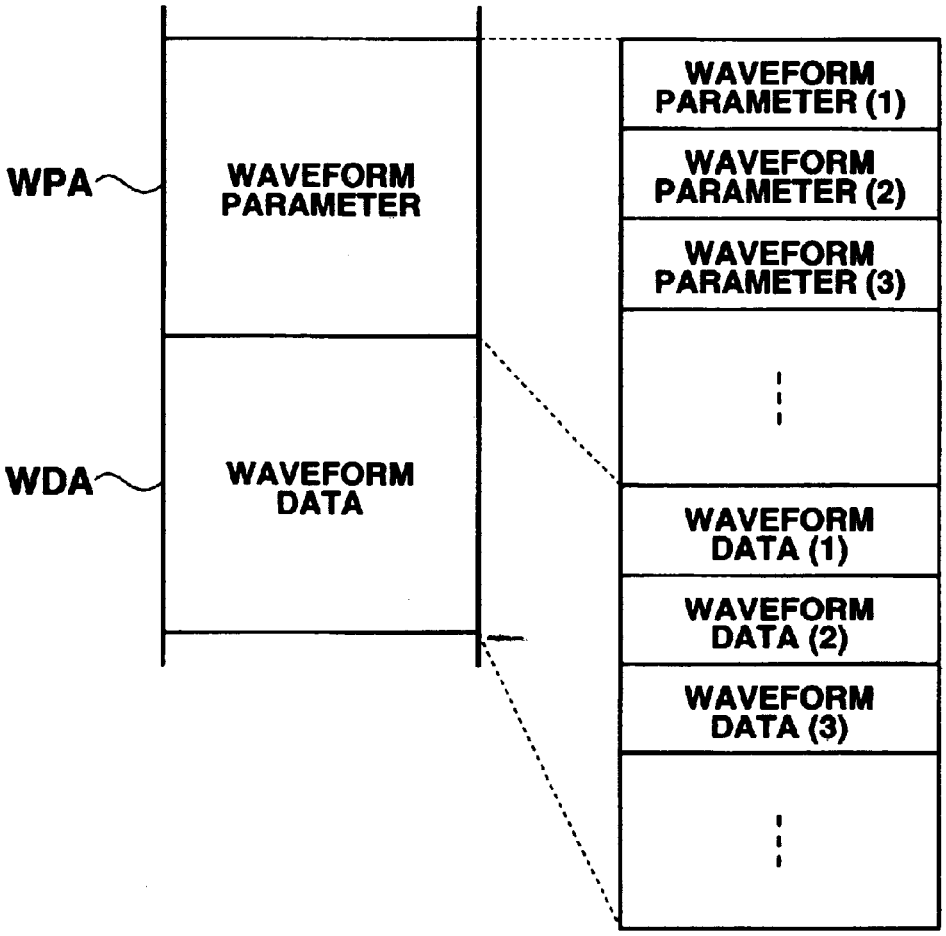
FIG. 2 is a view showing a memory arrangement of a data ROM 5.

Next, the arrangement of the data ROM 5 will be explained with reference to FIG. 2. The data ROM 5 includes a waveform data area WDA and a waveform parameter area WPA. The waveform data area WDA stores the waveform data (1) to (n) of the various tones. The waveform parameter area WPA stores waveform parameters (1) to (n) corresponding to the waveform data (1) to (n) of the various tones. Each waveform parameter represents waveform properties that are referred to when the waveform data of a tone color corresponding to the waveform parameter is read out to generate a music sound. Specifically, the waveform parameter is composed of a waveform start address, a waveform loop width, and a waveform end address.

Accordingly, when, for example, the waveform data (1) is read out, the waveform data (1) starts to be read by referring to the waveform start address stored in the waveform parameter (1) corresponding to the tone, and when the waveform end address stored therein is reached, the waveform data (1) is repeatedly read out according to the waveform loop width.

(3) Arrangement of Work RAM 6

Figure 3:
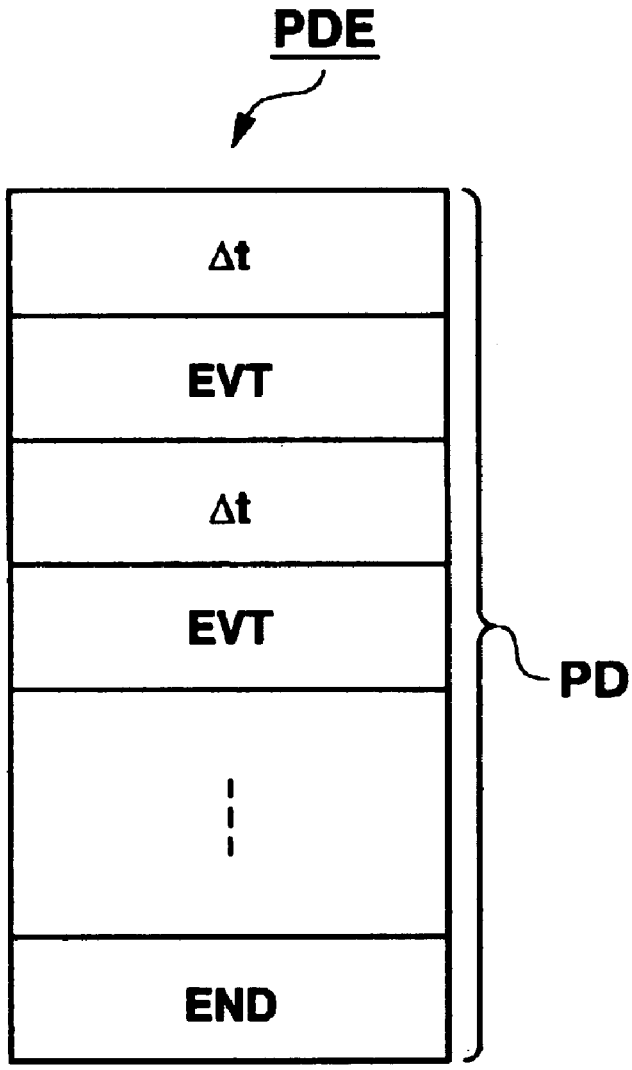
FIG. 3 is a view showing an arrangement of music performance data PD stored in a music performance data area PDE of a work RAM 6.

Next, the memory arrangement of the work RAM 6 will be described with reference to FIGS. 3 to 5. The work RAM 6 is composed of the music performance data area PDE, the conversion processing work area CWE, and the creation processing work area GWE, as described above.

The music performance data area PDE stores music performance data PD of the SMF format input externally through, for example, a MIDI interface (not shown). When the music performance data PD is formed in a Format 0 type, in which, for example, all the tracks (which correspond to a music performing part) are arranged as one track, music performance data PD includes timing data Δt and events EVT and the they are time sequentially addressed in correspondence to the procession of music as shown in FIG. 3. The timing data Δt represents timing at which a sound is generated and muted by a difference time to a previous event, each of the events EVT represents the pitch, the tone, and the like of a sound to be generated and to be muted, and the music performance data PD includes END data at the end thereof which indicates the end of the music.

Figure 4:
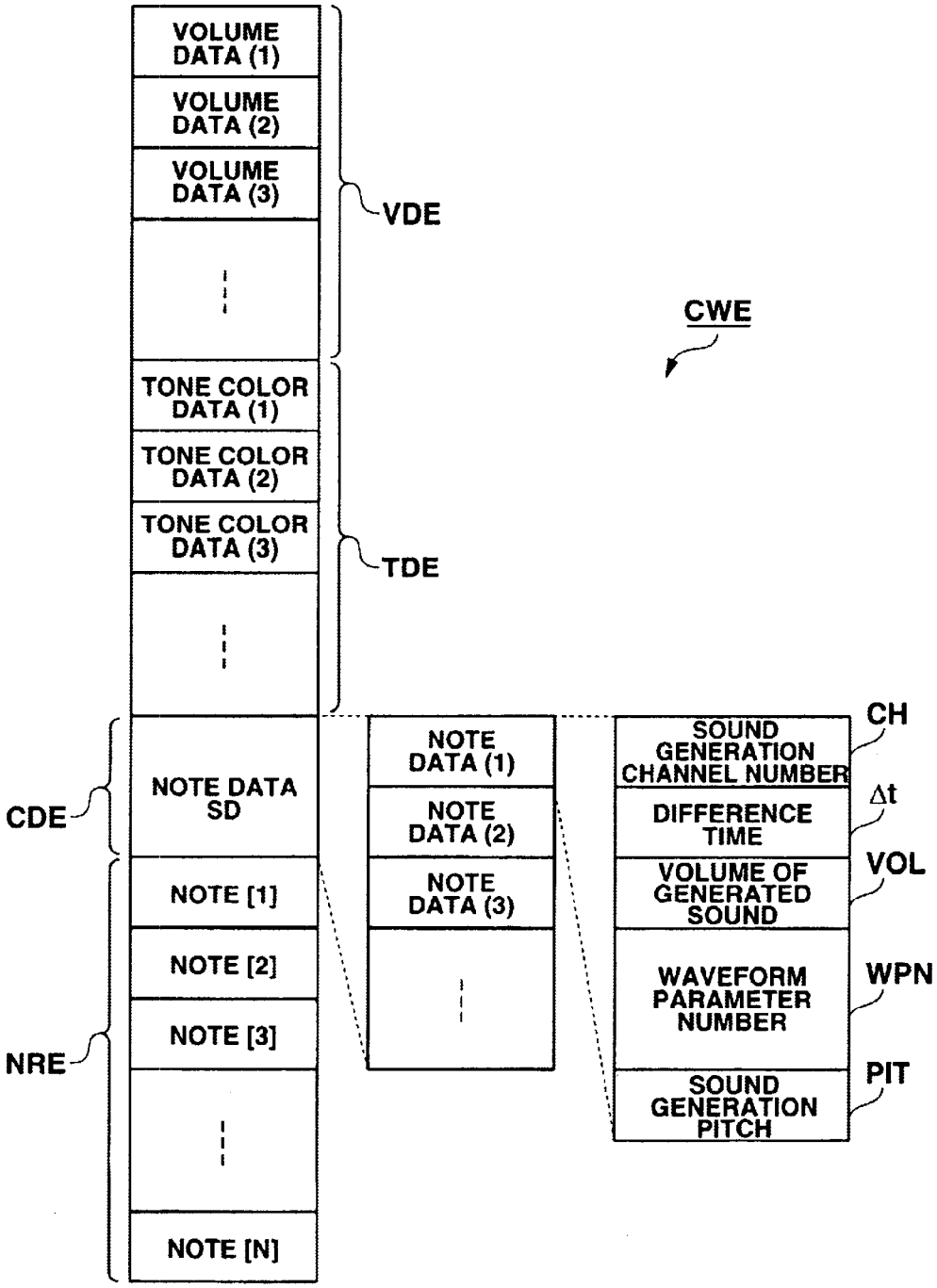
FIG. 4 is a memory map showing an arrangement of a conversion processing work area CWE included in the work RAM 6.
Figure 5:
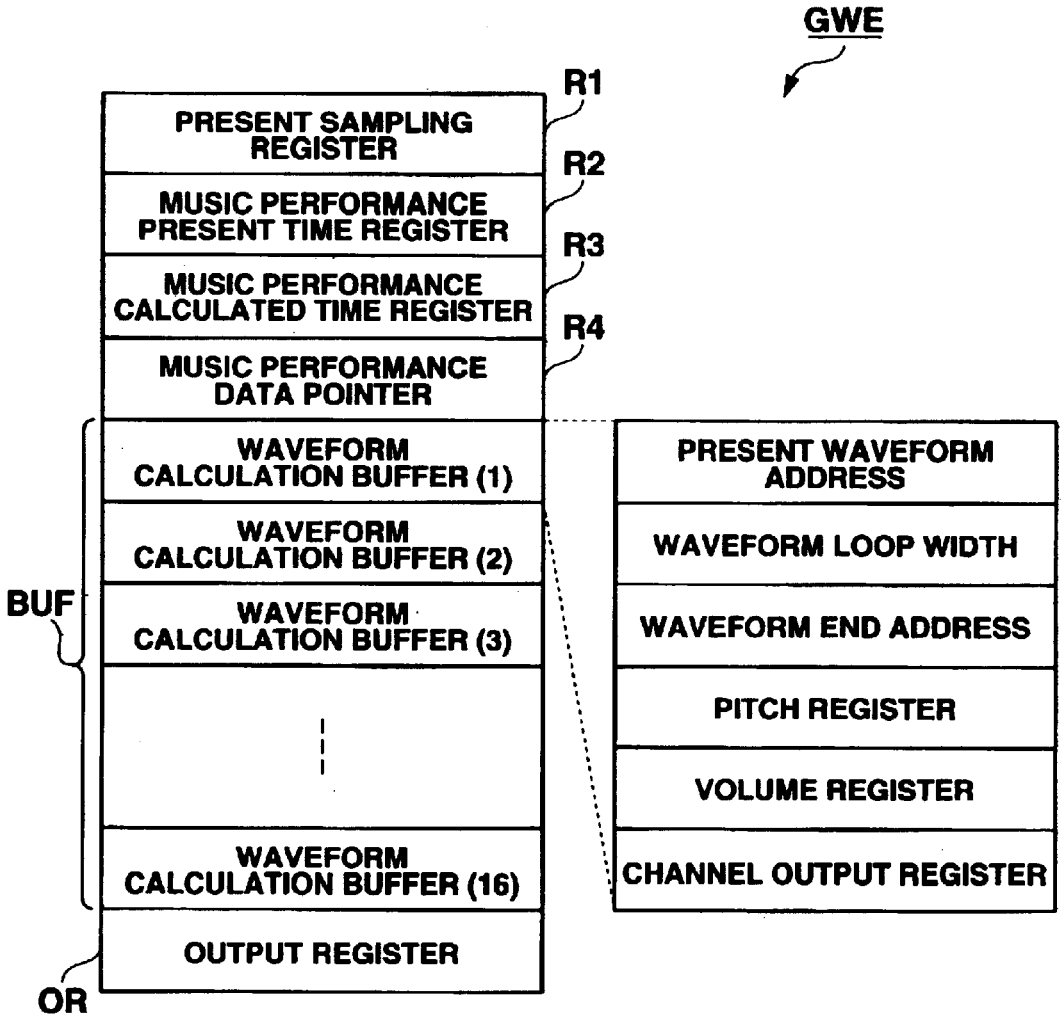
FIG. 5 is a memory map showing an arrangement of a creation processing work area GWE included in the work RAM 6.

As shown in FIG. 4, the conversion processing work area CWE is composed of a volume data area VDE, a tone color data area TDE, a conversion data area CDE, and a note register area NRE.

The conversion data area CDE stores sound data SD that is obtained by converting the music performance data PD of the SMF format into a sound format through conversion processing (that will be described later). The sound data SD is formed of a series of sound data SD(1) to SD(n) extracted from the respective events EVT constituting the music performance data PD. Each of the sound data SD(1) to SD(n) is composed of a sound generation channel number CH, the difference time Δt, a sound volume VOL, a waveform parameter number WPN, and a sound pitch PIT (frequency number).

The volume data area VDE includes volume data registers (1) to (n) corresponding to sound generation channels. When a volume event in the music performance data PD is converted into the sound data SD, volume data is temporally stored in the volume data register (CH) of the sound generation channel number CH to which the volume event is assigned.

The tone color data area TDE includes tone color data registers (1) to (n) corresponding to sound generation channels similarly to the volume data area VDE. When a tone event in the music performance data PD is converted into the sound data SD, a waveform parameter number WPN is temporally stored in the tone color data register (CH) of the sound generation channel number CH to which the tone event is assigned.

The note register area NRE includes sound registers NOTE [1] to [n] corresponding to the sound generation channels. When the music performance data PD is converted into the sound data SD, a sound generation channel number and a sound number are temporally stored in the note register NOTE [CH] corresponding to the sound generation channel number CH to which a note-on event is assigned.

The creation processing work area GWE includes various registers and buffers used in the creation processing for creating a music sound waveform (that will be described later) from the sound data SD described above. The contents of leading registers and buffers disposed in the creation processing work area GWE will be explained here with reference to FIG. 5. Reference numeral R1 denotes a present sampling register for cumulating the number of sampled waveforms read from waveform data. In this embodiment, a cycle, in which the 16 lower significant bits of the present sampling register R1 are set to "0", is timing at which music is caused to proceed. Reference numeral R2 denotes a music performance present time register for holding a present music performance time. Reference numeral R3 denotes a music performance calculated time register, and R4 denotes a music performance data pointer for holding a pointer value indicating sound data SD that is being processed at present.

BUF denotes a waveform calculation buffer disposed to each of the sound generation channels. In this embodiment, since 16 sounds are generated at maximum, there are provided waveform calculation buffers (1) to (16). Each waveform calculation buffer BUF temporarily stores the respective values of a present waveform address, a waveform loop width, a waveform end address, a pitch register, a volume register, and a channel output register. What is intended by the respective values will be described when the operation of the creation processing is explained later.

An output register OR holds the result obtained by cumulating the values of the channel output registers of the waveform calculation buffers (1) to (16), that is, the result obtained by cumulating the music sound data created for each sound generation channel. The value of the output register OR is supplied to the DAC 7.

(4) Operations:

Next, operations of the embodiment arranged as described above will be explained with reference to FIGS. 6 to 15. An operation of a main routine will be described first, and subsequently, operations of various types of processing called from the main routine will be described.

Figure 6:
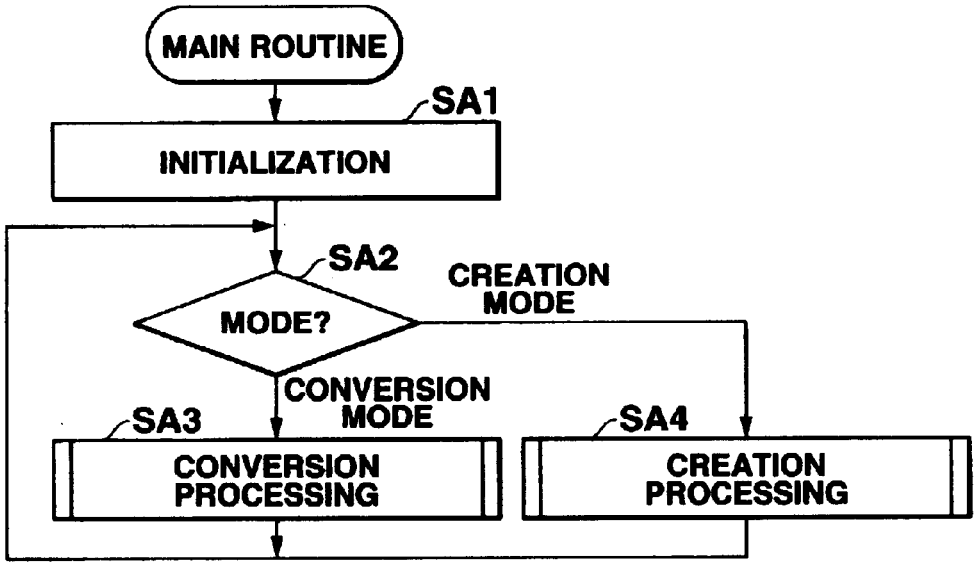
FIG. 6 is a flowchart showing an operation of a main routine.

(a) Operation of Main Routine (Overall Operation):

When power is supplied to the embodiment arranged as described above, the CPU 3 loads a control program from the program ROM 4 and executes the main routine shown in FIG. 6, in which processing in step SA1 is executed. In step SA1, initializing is executed to reset various registers and flags disposed in the work RAM 6 or to set initial values to them.

Subsequently, in step SA2, it is determined whether the conversion mode is selected or the creation mode is selected by the mode selection switch in the panel switch 1. When the conversion mode is selected, the conversion processing is executed in step SA3 so that the music performance data (MIDI data) of the SMF format is converted into the sound data SD. In contrast, when the creation mode is selected, the creation processing is executed in step SA4, thereby automatic musical performance is executed by creating music sound data based on the sound data SD.

Figure 7:
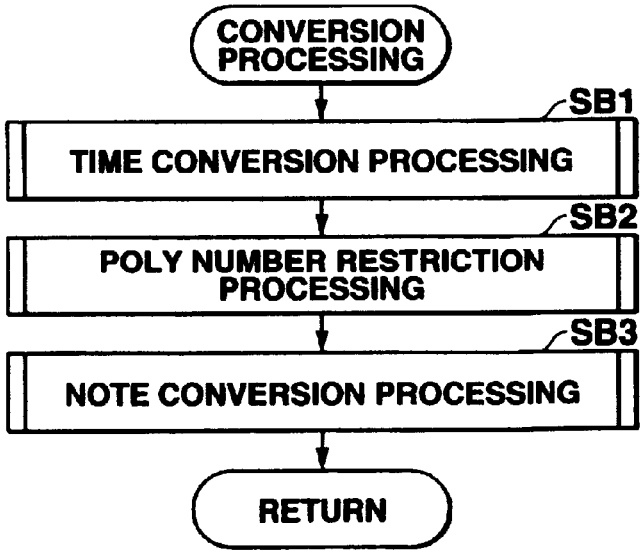
FIG. 7 is a flowchart showing an operation of conversion processing.

(b) Operation of Conversion Processing:

Next, the operation of the conversion processing will be explained with reference to FIG. 7. When the conversion mode is selected by manipulating the mode selection switch, CPU 3 goes to processing in step SB1, at which the conversion processing shown in FIG. 7 is executed, through step SA3. In step SB1, time conversion processing is executed to convert the timing data Δt of a relative time format defined in the music performance data PD into an absolute time format in which the timing data is represented by an elapsed time from a start of music performance.

Subsequently, in step SB2, poly number restriction processing is executed to adapt the number of simultaneous sound generating channels (hereinafter, referred to as "poly number") to the specification of the apparatus. Next, in step SB3, note conversion processing is executed to convert the music performance data PD into the sound data SD.

Figure 8:
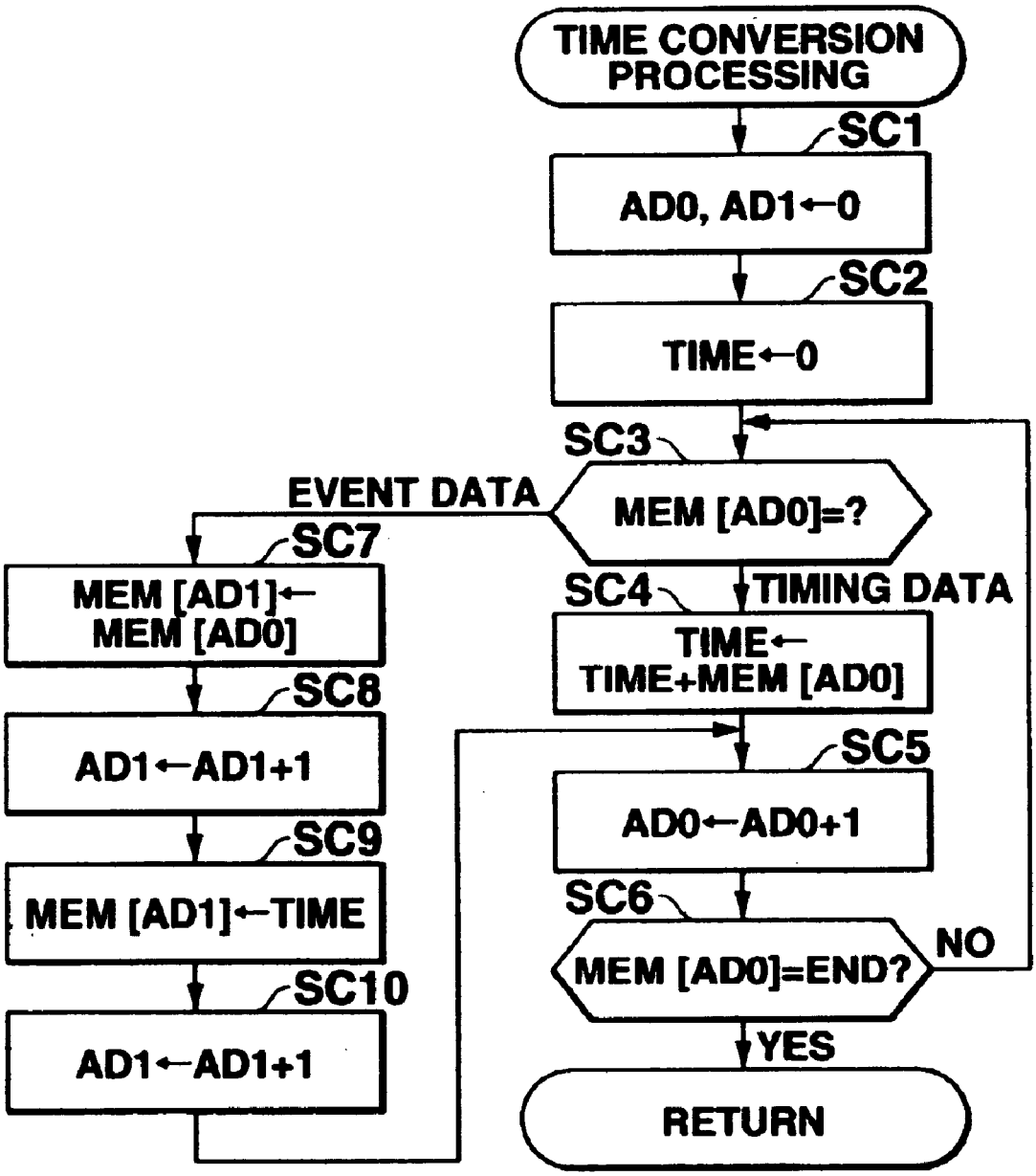
FIG. 8 is a flowchart showing an operation of time conversion processing.

(1) Operation of Time Conversion Processing:

Next, the operation of the time conversion processing will be explained with reference to FIG. 8. When the time conversion processing is executed through step SB1 described above, the CPU 3 executes processing in step SC1 shown in FIG. 8 to reset address pointers AD0 and AD1 to zero. The address pointer AD0 is a register that temporarily stores an address for reading out the timing data Δt from the music performance data PD stored in the music performance data area PDE of the work RAM 6 (refer to FIG. 3). In contrast, the address pointer AD1 is a register that temporarily stores a write address used when the music performance data PD, in which the timing data Δt is converted from the relative time format into the absolute time format, is stored again in the music performance data area PDE of the work RAM 6.

When the address pointers AD0 and AD1 are reset to zero, the CPU 3 executes processing in step SC2 in which a register TIME is reset to zero. Subsequently, in step SC3, it is determined whether a type of data MEM [AD0], which is read from the music performance data area PDE of the work RAM 6 according to the address pointer AD0, is the timing data Δt or an event EVT.

(a) When Data MEM [AD0] is Timing Data Δt:

When the data MEM [AD0] is read out just after the address pointer AD0 is reset to zero, the timing data Δt, which is addressed at the leading end of the music performance data PD, is read out. Thus, the CPU 3 executes processing at SC4 at which the read timing data Δt is added to the register TIME.

Next, in step SC5, the address pointer AD0 is incremented and advanced. When the CPU 3 goes to step SC6, it is determined whether or not the END data is read out from the music performance data area PDE of the work RAM 6 according to the advanced address pointer AD0, that is, it is determined whether or not the end of an music piece is reached. When the end of the music piece is reached, the result of determination is "YES", and this processing is finished. Otherwise, the result of determination is "NO", and the CPU 3 returns to the processing in step SC3 at which the type of read data is determined again.

In steps SC3 to SC6, the timing data Δt is added to the register TIME each time it is read out from the music performance data area PDE of the work RAM 6 according to the advancement of the address pointer AD0. As a result, the value of the register TIME is converted into an elapsed time obtained by cumulating the timing data Δt of the relative time format representing the difference time to a previous event, that is, the value of the register TIME is converted into the absolute time format in which a music start point is set to "0".

(b) When Data MEM [AD0] is Event EVT:

When the data read out from the music performance data area PDE of the work RAM 6 according to the advancement of the address pointer AD0 is the event EVT, the CPU 3 executes processing in step SC7. In step SC7, the read event EVT (MEM [AD0]) is written to the music performance data area PDE of the work RAM 6 according to the address pointer AD1.

Next, in step SC8, the address pointer AD1 is advanced, and, in subsequent step SC9, the timing value of the absolute time format stored in the register TIME is written to the music performance data area PDE of the work RAM 6 according to the advanced address pointer AD1. Then, in step SC10, after the address pointer AD1 is further advanced, the CPU 3 executes the processing in step SC5 described above.

As described above, when the event EVT is read out from the music performance data area PDE of the work RAM 6 according to the advancement of the address pointer in steps SC7 to SC10, the event EVT is stored again in the music performance data area PDE of the work RAM 6 according to the address pointer AD1, and subsequently the timing value of the absolute time format stored in the register TIME is written to the music performance data area PDE of the work RAM 6 according to the advanced address pointer AD1.

As a result, the music performance data PD of the relative time format stored in the sequence of Δt→EVT→Δt→EVT . . . is converted into the music performance data PD of the absolute time format stored in the sequence of EVT→TIME→EVT→TIME . . . .

Figure 9:
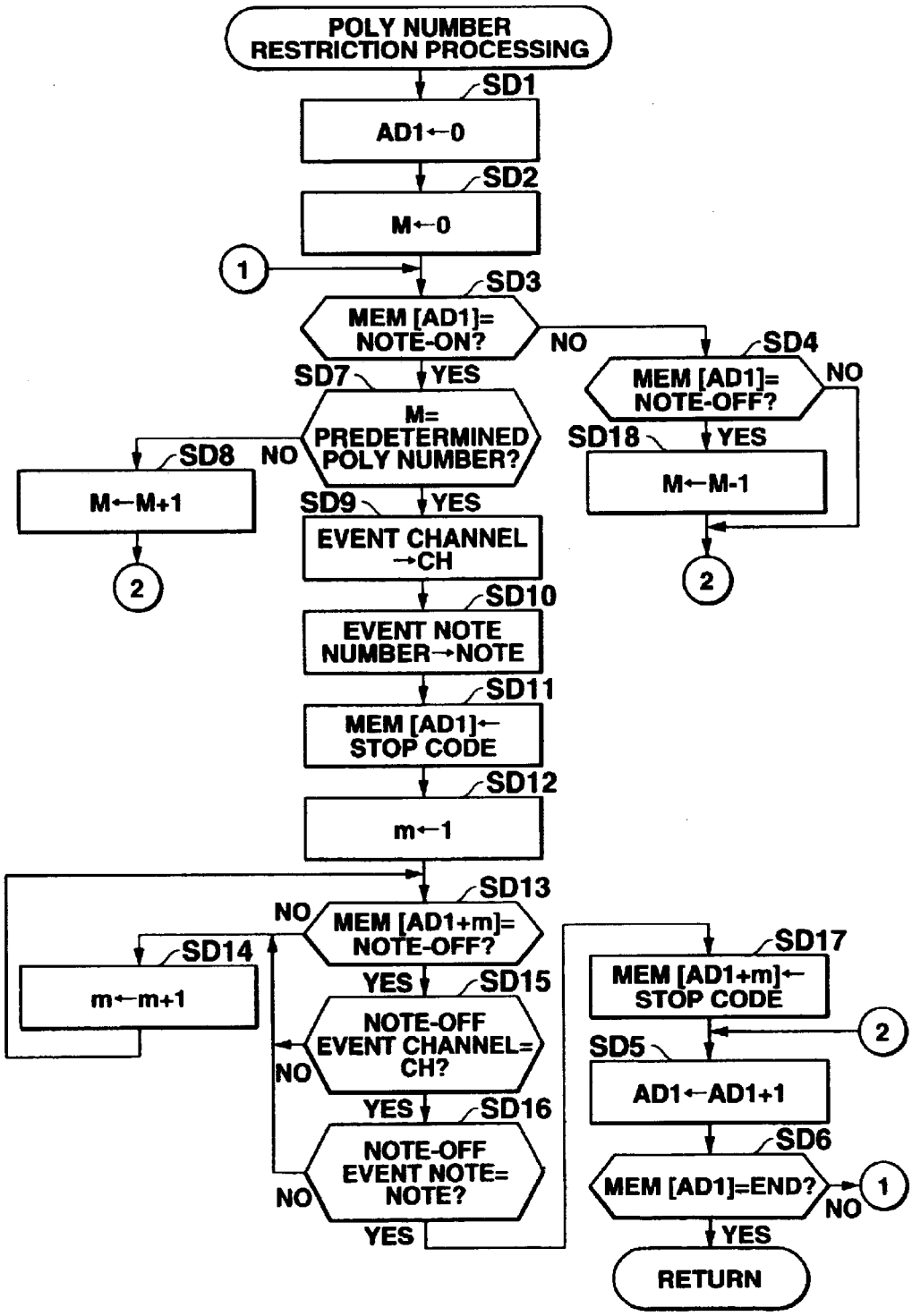
FIG. 9 is a flowchart showing an operation of poly number restriction processing.

(2) Operation of Poly Number Restriction Processing:

Next, the operation of the poly number restriction processing will be explained with reference to FIG. 9. When this processing is executed through step SB2 described above (refer to FIG. 7), the CPU 3 executes processing in step SD1 shown in FIG. 9. In step SD1, after the address pointer AD1 is reset to zero, a register M for counting a sound generation poly number is reset to zero in step SD2. In steps SD3 and SD4, it is determined whether data MEM [AD1] read out from the music performance data area PDE of the work RAM 6 according to the address pointer AD1 is a note-on event, a note-off event or an event other then the note-on/off events.

The Operation will be explained below as to each of the cases in which the data MEM [AD1] read out according to the address pointer AD1 is "the note-on event", "the note-off event" and "the event other than the note-on/off events".

(a) In the Case of Event Other than Note-On/Off Events

In this case, since any of the results of determination in steps SD3 and SD4 is "NO", the CPU 3 goes to step SD5. In step SD5, the address pointer AD1 is incremented and advanced. In step SD6, it is determined whether or not the data MEM [AD1] read out from the music performance data area PDE of the work RAM 6 according to the advanced address pointer AD0 is END data, that is, it is determined whether or not the end of music is reached. When the end of music is reached, the result of determination is "YES", and the processing is finished. Otherwise, the result of determination is "NO", and the CPU 3 returns to the processing in step SD3 described above.

(b) In the Case of Note-On Event:

In this case, the result of determination in step SD3 is "YES", and the CPU 3 goes to step SD7. In step SD7, it is determined whether the value of the register M reaches a predetermined poly number, that is, whether or not an empty channel exists. Note that the term "predetermined empty channel" used here means the sound generation poly number (the number of simultaneously sound generating channels) specified in the automatic music performing apparatus.

When one or more empty channels exist, the result of determination is "NO, and the CPU 3 executes processing in step SD8 in which the register M is incremented and advanced, and then the CPU 3 executes the processing in step SD5 and the subsequent steps to thereby read out a next event EVT.

In contrast, when the value of the register M reaches the predetermined poly number and no empty channel exists, the result of determination is "YES", and the CPU 3 goes to step SD9. In step SD9, the sound generation channel number included in the note-on event is stored in a register CH, and the note number included in the note-on event is stored in a register NOTE in subsequent step SD10.

When the sound generation channel number and the note number of the note-on event, to which sound generation cannot be assigned, are temporarily stored, the CPU 3 goes to step SD11 at which a stop code is written to the data MEM [AD1], which is read out from the music performance data area PDE of the work RAM 6 according to the address pointer AD1, to indicate that the event is ineffective.

Next, in steps SD12 to SD17, the sound generation channel number and the note number, which are temporarily stored in steps SD9 and SD10 and to which sound generation cannot be allocated, are referred to, and a note-off event corresponding to the note-on event is found from the music performance data area PDE of the work RAM 6, and the stop code is written to the note-off event to indicate that the event is ineffective.

That is, an initial value "1" is set to a register m that holds a search point in step SD12, and it is determined in subsequent step SD13 whether or not data MEM [AD1+1], which is read out from the music performance data area PDE of the work RAM 6 according to the address pointer AD1 to which the value of the register m (search pointer) is added, is a note-off event.

When the data MEM [AD1+1] is not the note-off event, the result of determination is "NO", and the CPU 3 goes to step SD14 at which the search pointer stored in the register m is advanced. Then, the CPU 3 returns to step SD13 again at which it is determined whether or not the data MEM [AD1+m], which is read out from the music performance data area PDE of the work RAM 6 according to the address pointer AD1 to which the advanced search point is added, is a note-off event.

Then, when the data MEM [AD1+m] is the note-off event, the result of determination is "YES", and the CPU 3 executes processing in step SD15 in which it is determined whether or not the sound generation channel number included in the note-off event agrees with the sound generation channel number stored in the register CH. When they are not agree with each other, the result of determination is "NO". Then, the CPU 3 executes processing in step SD14 in which the search pointer is advanced, and then the CPU 3 returns to the processing in step SD13.

In contrast, when the sound generation channel number included in the note-off event agrees with the sound generation channel number stored in the register CH, the result of determination is "YES", and the CPU 3 goes to step SD16. In step SD16, it is determined whether or not the note number included in the note-off event agrees with the note number stored in the register NOTE, that is, it is determined whether or not the note-off event is a note-off event corresponding to the note-on event to which sound generation cannot be assigned.

When the note-off event is not the note-off event corresponding to the note-on event to which the sound generation cannot be assigned, the result of determination is "NO", and the CPU 3 executes the processing in step SD14. Otherwise, the result of determination is "YES", and the CPU 3 goes to step SD17. In step SD17, the stop code is written to the data MEM [AD1+m], which is read from the music performance data area PDE of the work RAM 6 according to the address pointer AD1 to which the value of the register m (search pointer) is added to indicate that the event ineffective.

As described above, when the sound generation poly number defined by the music performance data PD exceeds the specification of the apparatus, the sound generation poly number can be restricted to a sound generation poly number that is in agreement with the specification of the apparatus because the note-on/off events in the music performance data PD, to which the sound generation cannot be assigned, are rewritten to the stop code which indicates that the events are ineffective.

(c) In the Case of Note-Off Event:

In this case, the result of determination in step SD4 is "YES", the CPU 3 goes to step SD18 at which the sound generation poly number stored in the register M is decremented. Then, the CPU 3 goes to step SD5 at which the address pointer AD1 is incremented and advanced, and it is determined whether or not the end of music is reached in subsequent step SD6. When the end of music is reached, the result of determination is "YES", and this routine is finished. When the end of music is not reached, the result of determination is "NO", and the CPU 3 returns to the processing in step SD3 described above.

Figure 10:
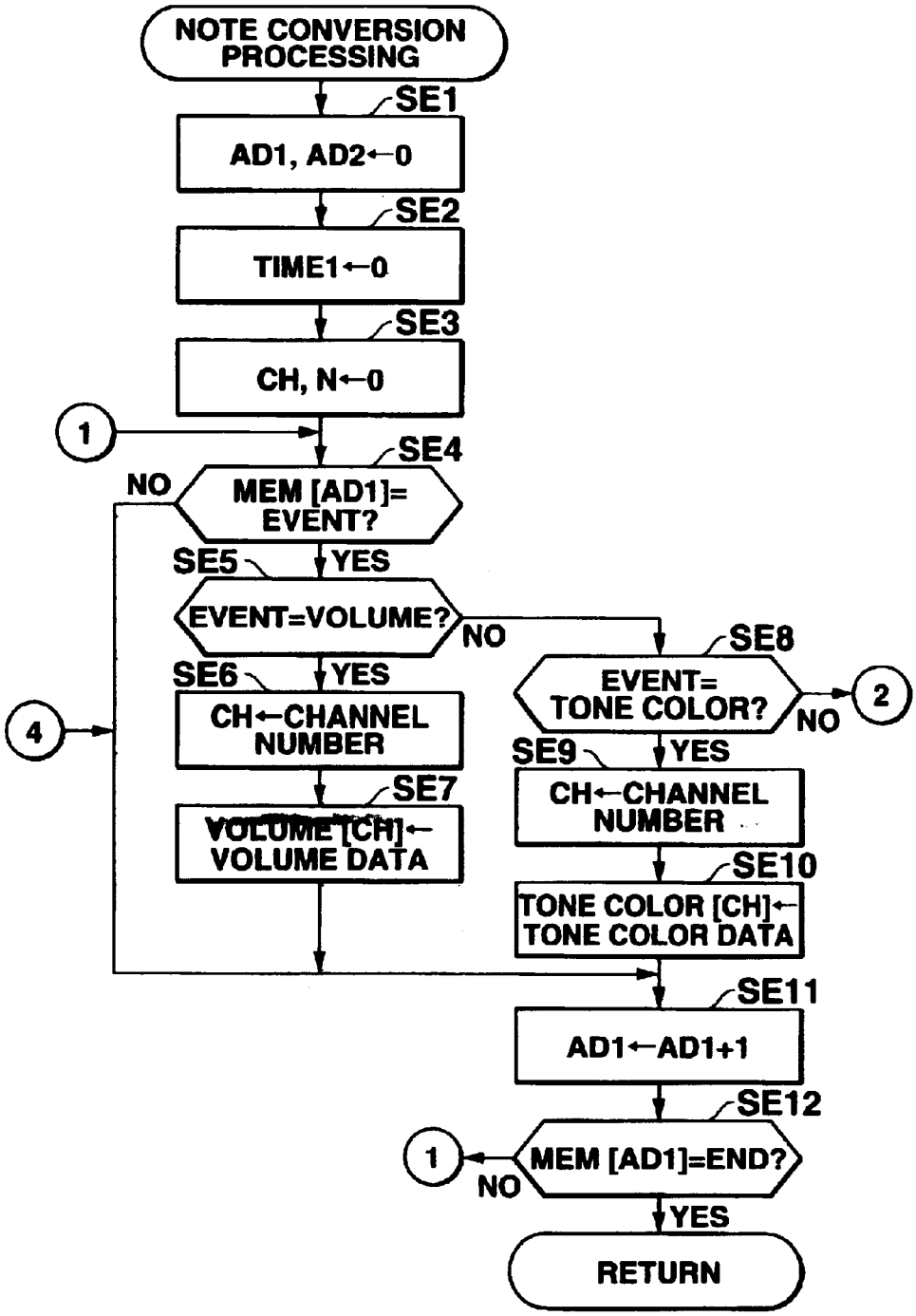
FIG. 10 is a flowchart showing an operation of sound conversion processing.

(3) Operation of Sound Conversion Processing:

Next, an operation of sound conversion processing will be explained with reference to FIGS. 10 to 12. When this processing is executed through step SB3 (refer to FIG. 7), the CPU 3 executes processing in step SE1 shown in FIG. 10. In step SE1, the address pointer AD1 and an address pointer AD2 are reset to zero. The address pointer AD2 is a register for temporarily storing a write address when the sound data SD converted from the music performance data PD is stored in the conversion data area CDE of the work RAM 6.

Subsequently, in steps SE2 and SE3, registers TIME1 and N and the register CH are reset to zero, respectively. Next, in step SE4, it is determined whether or not the data MEM [AD1], which is read out from the music performance data area PDE of the work RAM 6 according to the address pointer AD1, is an event EVT.

In the following description, the operation will explained as to a case in which the data MEM [AD1] read out from the music performance data area PDE of the work RAM 6 is the event EVT and as to a case in which it is timing data TIME.

Note that the data MEM [AD1], which is read out from the music performance data area PDE of the work RAM 6, is music performance data PD that is converted into the absolute time format in the time conversion processing (refer to FIG. 8) described above and stored again in the sequence of EVT→TIME→EVE→TIME . . . .

(a) In the Case of Timing Data TIME:

When the timing data TIME represented by the absolute time format is read out, the result of determination in step SE4 is "NO", and the CPU 3 goes to step SE11 at which the address pointer AD1 is incremented and advanced. In step SE12, it is determined whether or not the data MEM [AD1], which is read out from the music performance data area PDE of the work RAM 6 according to the advanced address pointer AD1, is the END data representing the end of music. When the end of music is reached, the result of determination is "YES" and the processing is finished. When, however, the end of music is not reached, the result of determination is "NO", and the CPU 3 returns to the processing in step SE4 described above.

(b) In the Case of Event EVT:

When the event EVT is read out, processing will be executed according to the type of event. In the following description, the respective operations of cases in which the event EVT is "a volume event", "a tone event", "a note-on event" and "a note-off event" will be explained.

a. In the Case of Volume Event:

When the data MEM [AD1], which is read out from the music performance data area PDE of the work RAM 6 according to the address pointer AD1, is a volume event, the result of determination in step SE5 is "YES", and the CPU 3 executes processing at step SE6. In step SE6, the sound generation channel number included in the volume event is stored in the register CH, the volume data stored in the volume event is stored in a volume data register [CH] in subsequent step SE7, and then the CPU 3 executes the processing in step SE11 described above.

Note that the volume data register [CH] referred to here indicates a register corresponding to the sound generation channel number stored in the register CH of the volume data registers (1) to (n) disposed in the volume data area VDE of the work RAM 6 (refer to FIG. 4).

b. In the Case of Tone Color Event:

When the data MEM [AD1], which is read out from the music performance data area PDE of the work RAM 6 according to the address pointer AD1, is the tone event, the result of determination in step SE8 is "YES", and the CPU 3 executes processing at the SE9. In step SE9, the sound generation channel number included in the tone color event is stored in the register CH, the tone color data (waveform parameter number WPN) included in the tone color event is stored in a tone color data register [CH] in subsequent step SE10, and then the CPU 3 executes the processing in step SE 11 described above.

Figure 11:
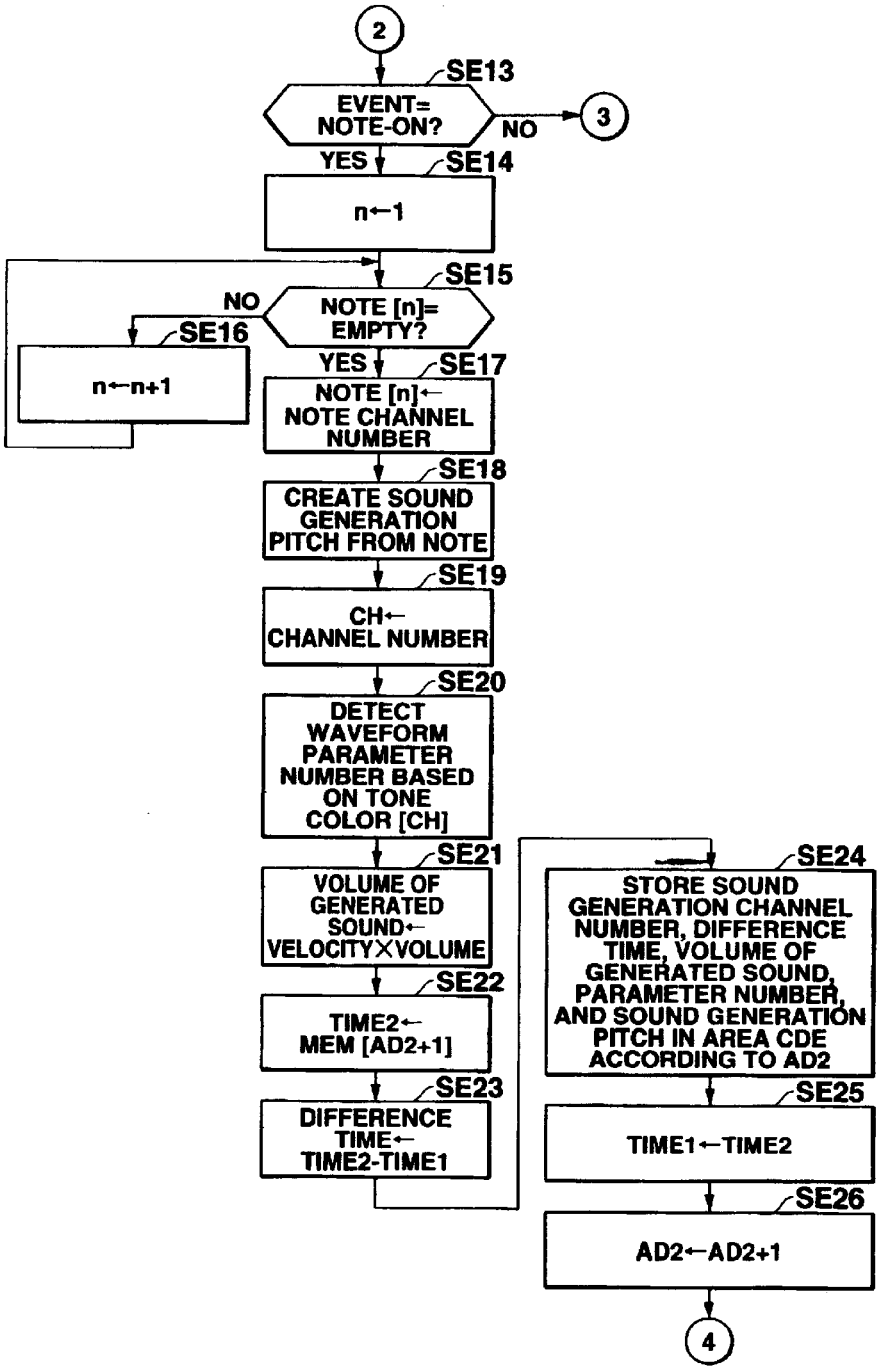
FIG. 11 is a flowchart showing an operation of sound conversion processing.

Note that the tone color data register [CH] referred to here indicates a register corresponding to the sound generation channel number stored in the register CH of the tone color data registers (1) to (n) disposed in the tone color data area TDE of the work RAM 6 (refer to FIG. 4).

c. In the Case of Note-On Event:

When the data MEM [AD1], which is read out from the music performance data area PDE of the work RAM 6 according to the address pointer AD1, is the note-on event, the result of determination in step SE13 shown in FIG. 11 is "YES", and the CPU 3 executes processing in step SE14. In steps SE14 to SE16, an empty channel to which no sound generation is assigned is searched.

That is, after an initial value "1" is stored in a pointer register n for searching the empty channel in step SE14, the CPU 3 goes to step SE15, at which it is determined whether or not a note register NOTE [n] corresponding to the pointer register n is the empty channel to which no sound generation is assigned.

When the note register NOTE [n] is not the empty channel, the result of determination is "NO", the point register n is advanced, and the CPU 3 is returned to the processing in step S15 at which it is determined whether or not the note register NOTE [n] corresponding to the advanced point register n is the empty channel.

As described above, when the empty channel is searched according to the advance of the point register n and the empty channel is found, the result of determination in step S15 is "YES", and the CPU 3 executes processing in step SE17. In step SE17, the note number and the sound generation channel number included in the note-on event is stored in the note register NOTE [n] of the empty channel. Next, in step SE18, a sound generation pitch PIT corresponding to the note number stored in the note register NOTE [n] is created. The sound pitch PIT referred to here is a frequency number showing a phase when waveform data is read out from the waveform data area WDA of the data ROM 5 (refer to FIG. 2).

When the CPU 3 goes to step SE19, the sound generation channel number is stored in the register CH, and tone color data (waveform parameter number WPN) is read out from the tone color data register [CH] corresponding to the sound generation channel number stored in the register CH in subsequent step SE20. In step SE21, a sound generation volume VOL is calculated by multiplying the volume data read out from the volume data register [CH] by the velocity included in the note-on event.

Next, the CPU 3 goes to step SE22 at which data MEM [AD2+1], which is read out from the music performance data area PDE of the work RAM 6 according to an address pointer AD2+1, that is, a timing value of the absolute time format is stored in a register TIME2. Subsequently, in step SE23, the difference time Δt is generated by subtracting the value of the register TIME1 from the value of the register TIME2.

As described above, when the sound generation channel number CH, the difference time Δt, the sound generation volume VOL, the waveform parameter number WPN, and the sound pitch PIT are obtained from the note-on event through steps SE18 to SE23, the CPU 3 goes to step SE24 at which they are stored as sound data SD (refer to FIG. 4) in the conversion data area CDE of the work RAM 6 according to the address pointer AD2.

Figure 12:
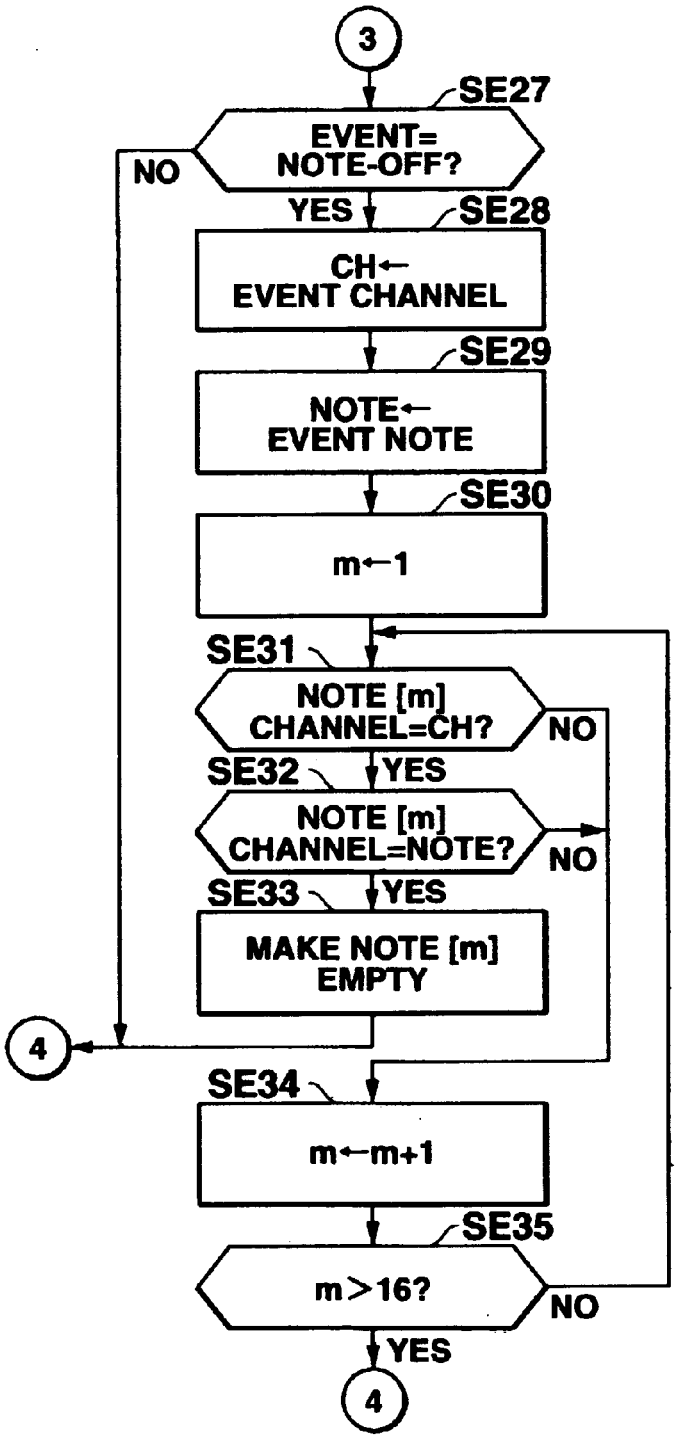
FIG. 12 is a flowchart showing an operation of sound conversion processing.

In step SE25, to calculate a relative time to a next note event, the value of the register TIME2 is stored in the register TIME1, the address pointer AD2 is advanced in subsequent step SE26, and then the CPU 3 returns to the processing in step SE 11 described above (refer to FIG. 10).

d. In the Case of Note-Off Event:

When the data MEM [AD1], which is read out from the music performance data area PDE of the work RAM 6 according to the address pointer AD1, is the note-off event, the result of determination in step SE27 shown in FIG. 12 is "YES", and the CPU 3 executes processing in step SE28. In step SE28, the sound generation channel number of the note-off event is stored in the register CH, and a note-turned-off note number is stored in a register NOTE in subsequent step SE29.

In steps SE30 to SE35, a note register NOTE, in which the sound generation channel number and the note number that correspond to the note-off are temporarily stored, is searched from note registers NOTE [1] to [16] for 16 sound generation channels, and the note register NOTE found is set as an empty channel.

That is, after an initial value "1" is stored in a pointer register m in step 30, the CPU 3 goes to step SE31 at which it is determined whether or not the sound generation channel number stored in the note register NOTE [m] corresponding to the pointer register m agrees with the sound generation channel number stored in the register CH. When they do not agree with each other, the result of determination is "NO", and the CPU 3 goes to step SE34 at which the pointer register m is incremented and advanced. Next, in step SE35, it is determined whether or not the value of the advanced pointer register m exceeds "16", that is, it is determined whether or not all the note registers NOTE [1] to [16] have been searched.

When they have not been searched, the result of determination is "NO", and the CPU 3 returns to the processing in step SE31 described above. In step SE31, it is determined again whether or not the sound generation channel number of the note register NOTE [m] agrees with the sound generation channel number of the register CH according to the value of the advanced pointer register m. When they agree with each other, the result of determination is "YES", and the CPU 3 goes to next step SE32 at which it is determined whether or not the note number stored in the note register NOTE [m] agrees with the note number stored in the register NOTE. When they do not agree with each other, the result of determination is "NO", the CPU 3 executes the processing in step SE34 described above at which the pointer register m is advanced again, and then the CPU 3 returns to the processing in step SE31.

When the note register NOTE [m], in which the sound generation channel number and the note number that correspond to the note-off are stored, is found according to the advance of the pointer register m, the results of determination in steps SE31 and SE32 are "YES", and the CPU 3 goes to step SE33 at which the note register NOTE [m] found is set as the empty channel and returns to the processing in step SE11 described above (refer to FIG. 10).

Figure 13:
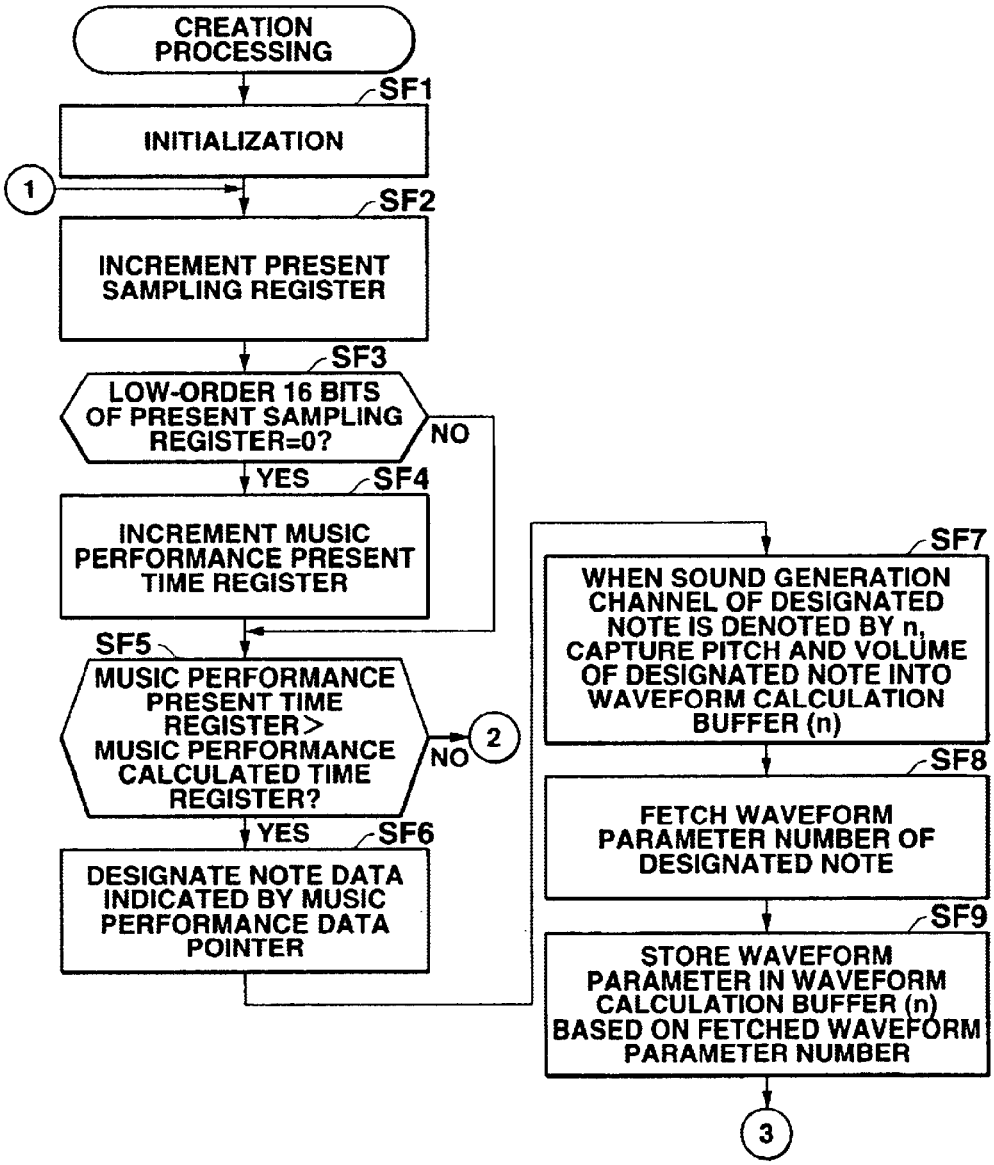
FIG. 13 is a flowchart showing an operation of creation processing.

(c) Operation of Creation Processing:

Next, the operation of the creation processing will be explained with reference to FIGS. 13 to 15. When the creation mode is selected by manipulating the mode selection switch, the CPU 3 executes the creation processing shown in FIG. 13 through step SA4 described above (refer to FIG. 6) and executes processing in step SF1. In step SF1, initializing is executed to reset the various registers and the flags disposed in the work RAM 6 or to set initial values to them. Next, in step SF2, the present sampling register R1 for cumulating the number of sampled waveforms is incremented, and it is determined in subsequent step SF3 whether or not the lower significant 16 bits of the advanced present sampling register R1 is "0", that is, it is determined whether or not the operation is at the music performance proceeding timing.

When the operation is at the music performance proceeding timing, the result of determination is "YES", and the CPU 3 goes to next step SF4, at which the music performance present time register R2 for holding a present music performance time is incremented, and goes to step SF5.

In contrast, when the lower significant 16 bits are not at the music proceeding timing, the result of determination in step SF3 is "NO", and the CPU 3 goes to step SF5. In step SF5, it is determined whether or not the value of the music performance present time register R2 is larger than the value of the music performance calculated time register R3, that is, it is determined whether or not the value of the music performance present time register R2 is at timing when a music performance calculation is executed to replay next sound data SD.

When the music performance calculation is already executed, the result of determination is "NO", and the CPU 3 executes processing in step SF13 (refer to FIG. 14) that will be described later. When, however, the value of the music performance present time register R2 is at the timing when the music performance calculation is executed, the result of determination is "YES", and the CPU 3 executes processing in step SF6.

In step SF6, sound data SD is designated from the conversion data area CDE of the work RAM 6 according to the music performance data pointer R4. Next, when the sound generation channel number of the designated sound data SD is denoted by n, the sound generation pitch PIT and the sound generation volume VOL of the sound data SD are set to the pitch register and the volume register in a waveform calculation buffer (n) disposed in the creation processing work area GWE of the work RAM 6, respectively in step SF7.

Subsequently, in step SF8, the waveform parameter number WPN of the designated sound data SD is read out. In step SF9, a corresponding waveform parameter (waveform start address, waveform loop width, and waveform end address) is stored in the waveform calculation buffer (n) from the data ROM 5 based on the read waveform parameter number WPN.

Figure 14:
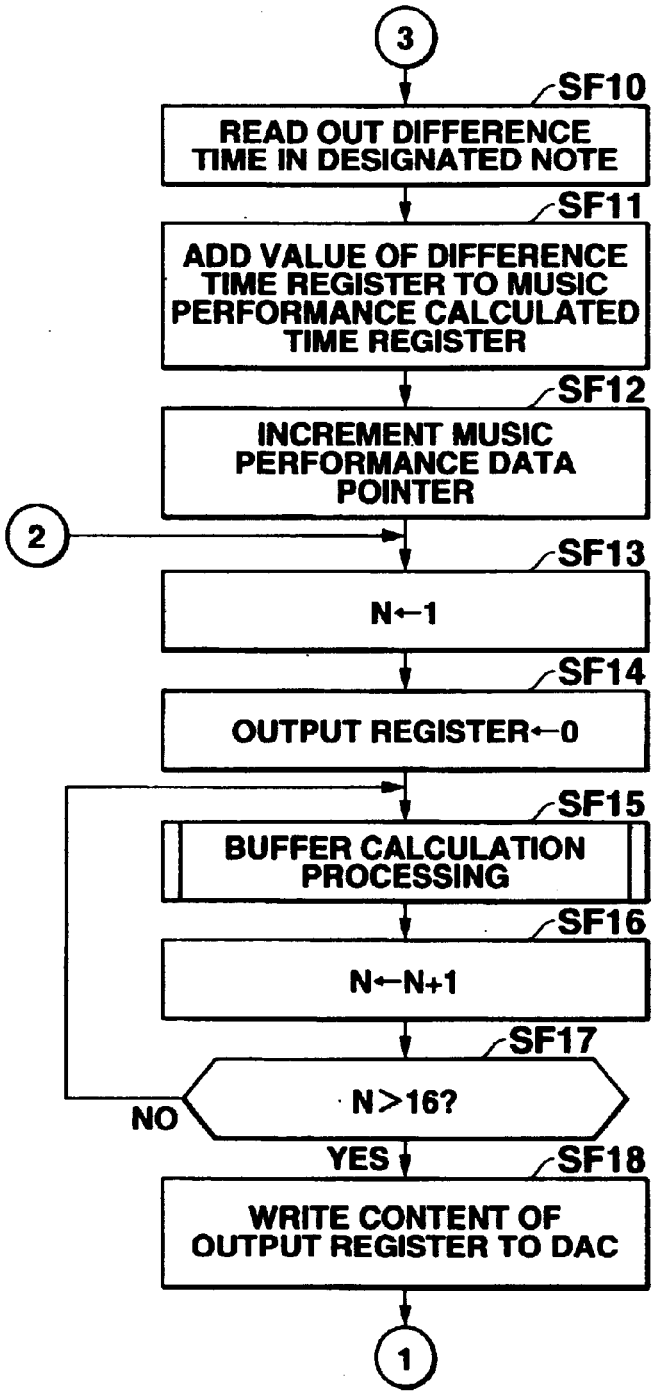
FIG. 14 is a flowchart showing an operation of creation processing.

Next, in step SF10 shown in FIG. 14, the difference time Δt of the designated sound data SD is read out, and the read difference time Δt is added to the music performance calculated time register R3 in subsequent step SF11.

When preparation for replaying the designated sound data SD is finished as described above, the CPU 3 executes processing in step SF12 in which the music performance data pointer R4 is incremented. In steps SF13 to SF17, waveforms are created for respective sound generation channels according to the waveform parameters, the sound generation volumes, and the sound generation pitches that are stored in the waveform calculation buffers (1) to (16), respectively, and music sound data corresponding to the sound data SD is generated by cumulating the waveforms.

That is, in steps SF13 and SF14, an initial value "1" is set to a pointer register N, and the content of the output register OR is reset to zero. In step SF15, buffer calculation processing for creating music sound data for the respective sound generation channels is executed based on the waveform parameters, the sound generation volumes, and the sound generation pitches that are stored in the waveform calculation buffers (1) to (16).

Figure 15:
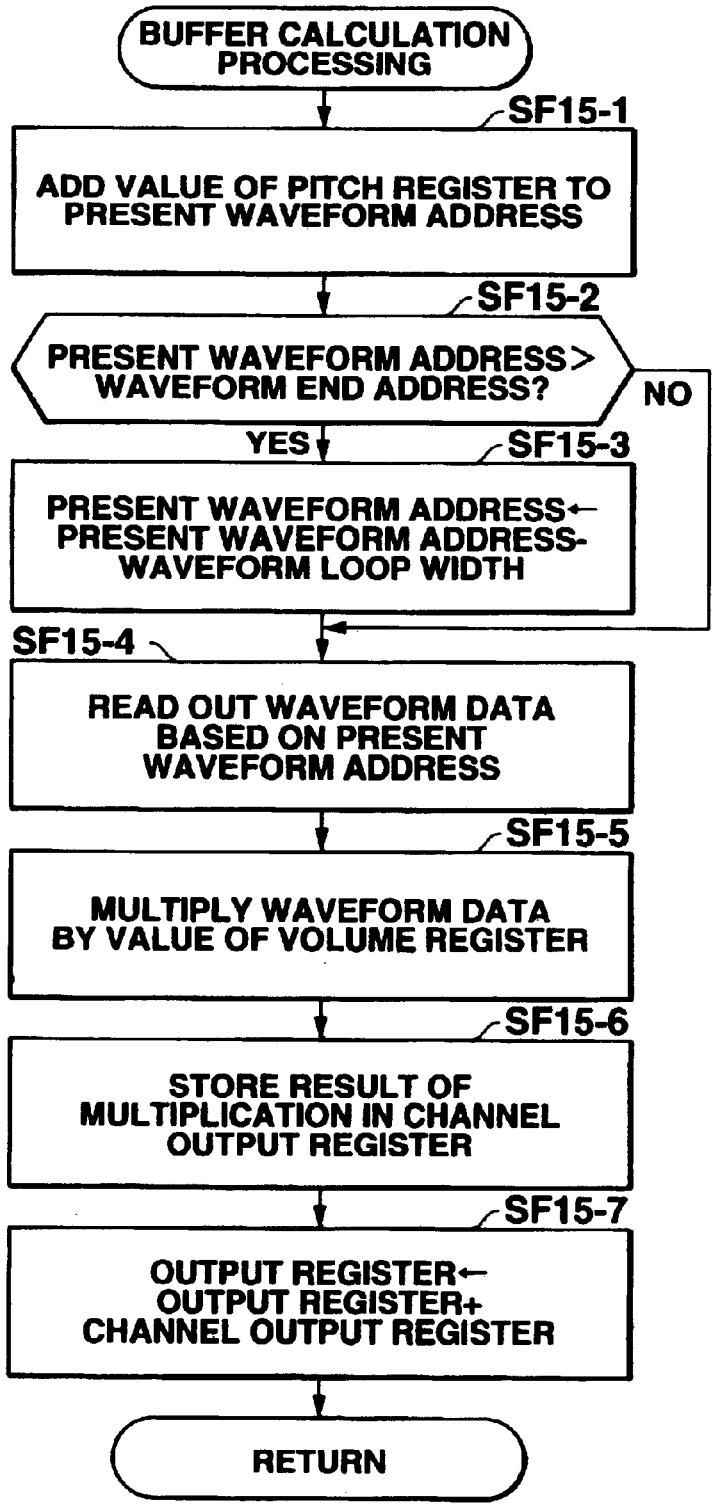
FIG. 15 is a flowchart showing an operation of buffer calculation processing.

When the buffer calculation processing is executed, the CPU 3 executes processing in step SF15-1 shown in FIG. 15 in which the value of the pitch register in the waveform calculation buffer (N) corresponding to the pointer register N is added to the present waveform address of the waveform calculation buffer (N). Next, the CPU 3 goes to step SF15-2 at which it is determined whether or not the present waveform address, to which the value of the pitch register is added, exceeds the waveform end address. When the present waveform address does not exceed the waveform end address, the result of determination is "NO", and the CPU 3 goes to step SF15-4. Whereas, when the present waveform address exceeds the waveform end address, the result of determination is "YES", and the CPU 3 goes to next step SF15-3.

In step SF15-3, a result obtained by subtracting the waveform loop width from the present waveform address is set to a new present address waveform address. When the CPU 3 goes to step SF15-4, the waveform data of a tone color designated by the waveform parameter is read out from the data ROM 5 according to the present waveform address.

Next, in step SF15-5, music sound data is created by multiplying the read waveform data by the value of the volume register. Subsequently, in step SF15-6, the music sound data is stored in the channel output register of the waveform calculation buffer (N). Thereafter, the CPU 3 goes to step SF15-7 at which the music sound data stored in the channel output register is added to an output register OB.

When the buffer calculation processing is finished as described above, the CPU 3 executes processing in step SF16 shown in FIG. 14 in which the pointer register N is incremented and advanced, and it is determined whether or not the advanced pointer register N exceeds "16", that is, it is determined whether or not the music sound data has been created as to all the sound generation channels in subsequent step SF17. When the music sound data is still being created, the result of determination is "NO", and the CPU 3 returns to the processing in step SF15, and repeats the processing in step SF15 to SF17 until the music sound data has been created for all the sound generation channels.

When the music sound data has been created for all the sound generation channels, the result of determination in step SF17 is "YES", and the CPU 3 goes to step SF18. In step SF18, the content of the output register OR, which cumulates the music sound data of the respective sound generation channels in the buffer calculation processing (refer to FIG. 15) described above and holds the cumulated music sound data, is output to the DAC 7. Thereafter, the CPU 3 returns to the processing in step SF2 (refer to FIG. 13) described above.

As described above, in the creation processing, the music performance present time register R is advanced each music procession timing, and when the value of the music performance present time register R2 is larger than the value of the music performance calculated time register R3, that is, when timing, at which a music performance calculation is executed to replay the sound data SD, is reached, automatic music performance is caused to proceed by creating music sound data according to the sound data SD designated by the music performance data pointer R4.

As described above, according to this embodiment, automatic music performance is executed by converting the music performance data PD of the SMF format into the sound data SD by the CPU 3 and by generating music sound data corresponding to the converted sound data SD. Therefore, the automatic music performance can be executed according to the music performance data of the SMF format without a dedicated sound source for interpreting and executing the music performance data PD of the SMF format.

It should be noted that, in the embodiment described above, after the music performance data PD of the SMF format supplied externally is stored once in the music performance data area PDE of the work RAM 6, the music performance data PD read out from the music performance data area PDE is converted into the sound data SD, and the automatic music performance is executed according to the sound data SD. However, the embodiment is not limited thereto, and the sound data SD may be read out while converting the music performance data PD of the SMF format supplied from a MIDI interface into the sound data SD in real time. With this arrangement, it is also possible to realize a MIDI musical instrument without a dedicated sound source.

What is claimed is:

1. An automatic music performing apparatus comprising:

music performance data storing means for storing music performance data of a relative time format including an event group which includes at least note-on events for indicating a start of sound generation of music sounds, note-off events for indicating an end of sound generation of the music sounds, volume events for indicating volumes of the music sounds, and tone color events for indicating tone colors of the music sounds with respective events arranged in a music proceeding sequence, and difference times each interposed between respective events and representing a time interval at which both the events are generated in sequence;

conversion means for converting the music performance data of the relative time format stored in the music performance data storing means into sound data representing sound generation properties of each sound; and music performing means for automatically executing music performance by generating music sounds corresponding to the sound generation properties represented by sound data converted by the conversion means.

2. An automatic music performing apparatus according to claim 1, wherein the conversion means comprises:

time conversion means for converting the music performance data of the relative time format into music performance data of an absolute time format in which alternately arranged events and times representing a timing, at which the events are generated, as periods of time elapsed from a time at which music starts and for storing again the music performance data of the absolute time format in the music performance data storing means; and sound conversion means including converted data storing means, for sequentially reading out the music performance data of the absolute time format stored in the music performance data storing means, converting read music performance data into sound data representing the sound generation properties of each note, and storing the sound data in an area of the converted data storing means in which the sound data is stored.

3. An automatic music performing apparatus according to claim 2, wherein the sound conversion means includes restriction means for, when a number of simultaneously generating sounds that is defined by music performance data of the absolute time format converted by the time conversion means exceeds a sound generation assignable number, rewriting note-on events to which sound generation cannot be assigned and note-off events corresponding to the note-on events to stop codes indicating that the note-on events are ineffective to restrict the number of simultaneously generating sounds of the music performance data.

4. An automatic music performing apparatus according to claim 2, wherein the converted data storing means has areas for storing volume data and tone color data separately from the area for storing the note data, and the sound conversion means renews, each time a volume event is read out from the music performance data storing means, the volume data stored in an area for storing the volume data based on a volume indicated by the event as well as renews, each time a tone color event is read out from the music performance data storing means, an area for storing the tone color data based on a tone indicated by the event.

5. An automatic music performing apparatus according to claim 1, wherein the music performing means comprises waveform storing means for storing therein a plurality of pieces of waveform data corresponding to a tone color of a music sound to be generated, and a plurality of parameters including a waveform start address, a waveform loop width, and a waveform end address of each piece of waveform data.

6. An automatic music performing apparatus according to claim 5, wherein the sound data comprises a difference time indicating a period of time from a start of generation of each music sound to an end thereof, a volume of a music sound, a pitch of the music sound, and a parameter number representing a waveform parameter corresponding to a tone color of the music sound that is stored in the waveform storing means and to be generated.

7. An automatic music performing apparatus according to claim 6, wherein the sound conversion means includes difference time calculation means for calculating the difference time of sound data based on a difference between an elapsed time of timing, at which a note-on event included in the music performance data of the absolute time format is generated, and an elapsed time until a next note-on event is generated and for storing the sound data in an area for storing the sound data.

8. An automatic music performing apparatus according to claim 6, wherein the note-on event includes a note representing a pitch of a music sound to be generated, and the sound conversion means includes pitch determination means for determining a pitch included in sound data based on the note of the note-on event and storing the pitch in an area for storing the sound data.

9. An automatic music performing apparatus according to claim 6, wherein the note-on event includes a velocity, and the sound conversion means includes generated sound volume calculation means for calculating a generated sound volume included in the sound data based on the velocity and the volume stored in the area for storing the volume data and for storing a generated sound volume in an area for storing the sound data.

10. An automatic music performing apparatus according to claim 6, wherein the music performing means comprises:

sound reading means for sequentially reading out sound data from an area for storing the sound data;

waveform reading means for reading waveform data stored in the waveform storing means based on a waveform parameter designated by a waveform parameter number of sound data read out by the sound reading means at a rate based on a sound generation pitch of the sound data; and output means for multiplying waveform data read out by the waveform reading means by volume data of the sound data and outputting resultant data.

11. Automatic music performance processing program comprising:

a step of reading out music performance data of a relative time format comprising an event group, in which at least note-on events for indicating a start of sound generation of music sounds, note-off events for indicating an end of sound generation of music sounds, volume events for indicating volumes of the music sounds, and tone color events for indicating tone colors of music sounds are arranged in a music proceeding sequence and difference times each interposed between respective events and representing a time interval at which both the events are generated in sequence;

a step of converting read music performance data of the relative time format into sound data representing sound generation properties of each sound; and a step of automatically executing music performance by forming a music sound corresponding to sound generation properties shown by sound data converted by the conversion step.

* * * * *